United States Patent [19]

Warwick et al.

[11] Patent Number: 4,519,600

[45] Date of Patent: May 28, 1985

[54] CARD FEEDING, TRANSFER AND OUTPUT APPARATUS FOR AN AUTOMATIC EMBOSSING SYSTEM

[75] Inventors: Dennis J. Warwick, Richfield; Richard C. Nubson, Eden Prairie; Ronald B. Howes, Jr., Minneapolis, all of Minn.

[73] Assignee: Data Card Corporation, Minnetonka, Minn.

[21] Appl. No.: 534,350

[22] Filed: Sep. 21, 1983

[51] Int. Cl.[3] ..... B65H 5/22

[52] U.S. Cl. ..... 271/4; 271/85; 271/149; 271/268

[58] Field of Search ..... 271/4, 126, 149, 150, 271/267, 268, 85, 115, 119, 10, 14; 425/397, 385

[56] References Cited

U.S. PATENT DOCUMENTS

| | | | |
|---|---|---|---|
| Re. 27,809 | 11/1973 | Drillick | 101/18 |
| 3,743,114 | 7/1973 | Van Linder et al. | 271/119 |
| 3,966,193 | 6/1976 | Storace et al. | 271/126 |
| 4,268,024 | 5/1981 | Kokubo et al. | 271/149 |
| 4,271,012 | 6/1981 | LaManna et al. | 414/108 |

*Primary Examiner*—Bruce H. Stoner, Jr.
*Assistant Examiner*—John A. Carroll
*Attorney, Agent, or Firm*—Kinney & Lange

[57] ABSTRACT

An apparatus for feeding cards from a storage magazine to an automatic embossing system including an input hopper and card picking mechanism for engaging a card after it is stripped from a supply stack in the input hopper. The card is positioned by a transfer mechanism to receive embossed data from rotating embossing wheels. An output hopper receives good cards and rejected cards are deposited into a reject box.

13 Claims, 8 Drawing Figures

CARD FEEDING, TRANSFER AND OUTPUT APPARATUS FOR AN AUTOMATIC EMBOSSING SYSTEM

BACKGROUND OF THE INVENTION

1. Field of the Invention

The present invention relates to an automatic embossing system and more particularly to the input, card transport and output mechanisms for an embossing system for embossing multiple lines of information of a common credit card.

2. Description of the Prior Art

Automated embossing systems have found wide acceptance in the field. Two such systems are disclosed in U.S. Pat. Nos. Re. 27,809 to Drillick and 3,820,455 to Hencley et al. The systems of each of these patents are, relative to that of the present invention, high speed systems of substantial size and expense. Whereas such systems are ideally suited for high volume production of credit cards, they do not necessarily meet the requirements of low volume production, at least in view of cost and size factors.

The system of U.S. Pat. No. Re. 27,809 employs linear arrays of embossing elements, one embossing module being assigned the task of embossing characters on a single, corresponding embossing line of a card. As the card is transported past each module in succession, the characters required to be embossed on each successive line of the card are embossed as the card is presented to the appropriate punch and die pair of that module for each position on which that character is to appear on that line. The data processing requirements therefore must sort the data to be embossed in relation to the line on the card and the module to emboss that line and, for each such line, the position to each character in the succession in which it is provided in the embossing punch and die pairs of the module relative to the locations at which that character appears on that line. A very high through-put rate of cards is achieved in this equipment.

A somewhat lower cost system is disclosed in U.S. Pat. No. 3,820,455 with a somewhat reduced through-put rate. In this system, only a single embossing module, again with the punch and die pairs in a linear array, is employed. In this system, each card is transported past the module in a first direction parallel to the lines of character embossing to be provided on the card to successive index positions and, at each such index position, in a transverse direction such that the multiple embossing lines of each card are presented in succession to the row or array of character embossing elements for each index position in succession. Suitable sorting of the data to correlate the data to be embossed on the card with the position of the card relative to the embossing characters is preformed, whereby the multiple lines of embossed characters are produced on the card during a single such path of motion of the card past the embossing elements.

In each of the above systems, plural characters may be required to be embossed simultaneously at a given card position. This is not only consistent with the desired through-put rates to be attained, but also is required by the path of motion of the card past the embossing elements. The general configuration of the equipment and particularly the fixed linear array or row of embossing elements in conjunction with the requisite capability of potential for simultaneously embossing plural characters results in machines of rather substantial weight and size.

A somewhat lower through-put system is disclosed in U.S. Pat. Nos. 4,271,012, 4,180,338 and 4,088,216 which show a system utilizing a pair of embossing heads and a card transport mechanism for rapidly moving the card to apply each character in succession to all embossing locations on the cards. A mechanically complex drive mechanism for loading the cards from the input magazine and moving the cards through the embossing station is disclosed. In each step of the card feed and transport process, the positioning of the cards was critical and misalignment would affect print quality.

Heretofore in the prior art, however, the above automated embossing equipment and other such equipment as is available has still not satisfied the needs of low volume users, principally due to the desire of such users to have equipment which is smaller in physical size and concommitantly lighter in weight and which correspondingly is of lower cost, such users being readily willing to accept a lower through-put rate and increased reliability in line with their operating requirements.

SUMMARY OF THE INVENTION

Accordingly, it is an object of this invention to provide automatic embossing apparatus which is of reduced size and weight relative to that available heretofore in the prior art yet which can perform embossing of media such as credit cards in a fully automated manner.

Another object of the invention is to provide an embossing system which is of low cost, yet highly efficient and effective in operation.

Yet another object of this invention is to provide a card feed mechanism for an embossing system which reliably feeds cards from a stack to a card handling mechanism.

A further object of the invention is to provide a card feed and transport mechanism which is relatively insensitive to the longitudinal positioning of cards fed from the input magazine to the head of the card transfer path.

Still another object of this invention is to provide card handling and transport apparatus for reliably and accurately positioning a card to be embossed relative to the rotary embossing wheels.

A further object of this invention is to provide an output hopper and reject hopper mechanism for reliably separating reject cards from good cards after completion of the embossing step.

DETAILED DESCRIPTION OF THE DRAWINGS

Figure 1:
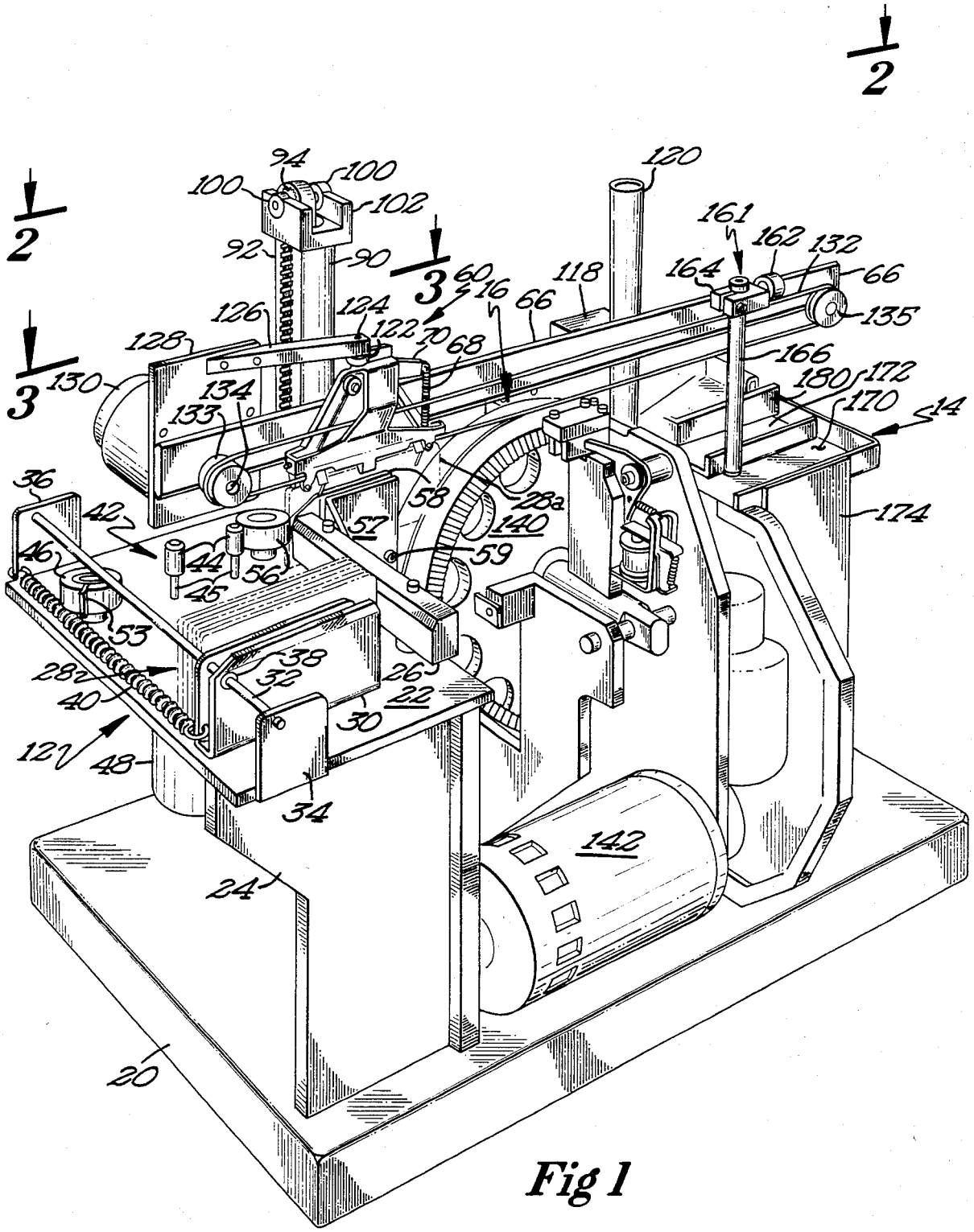
FIG. 1 is a perspective view of an automatic embossing system employing the present invention.

FIG. 1 shows, in perspective form, the essential elements of the inventive apparatus with the enclosing case removed for clarity. As shown in FIG. 1, the input hopper or feed magazine portion 12 is at the left side of the structure, the output and reject hopper portion 14 is at the right, and the embossing section 16 is at the center of the Figure. The specific details and structure of the various portions are described below.

INPUT HOPPER

Input hopper 12 is shown in FIG. 1 and in further detail in FIGS. 2, 3, 7 and 8.

The entire apparatus is mounted on a base or frame 20. The input hopper base plate 22 is supported by a vertical support member 24 mounted on base plate 20. Mounted on input hopper base plate 22 is a guide rail 26 which provides a side support and alignment guide for a stack of cards 28 positioned on the surface of hopper plate 22, as shown in FIG. 1.

A back-up plate 30 supports the bottom of card stack 28 on hopper plate 22. Back-up plate 30 is slidably mounted on a guide rod 32 which is mounted parallel to the surface of base plate 22 on support flanges 34 and 36, respectively. A suitable linear bearing 38 provides for a smooth sliding action of back-up plate 30 along support rod 32. An extension spring 40 provides the tracking force to urge back-up plate 30 toward support flange 36 to force the top card of card stack 28 into contact with stationary vertical card supports and guides 42. Card supports 42 support the front of the card stack 28 to hold it in a substantially vertical position. Each of the vertical supports 42 has a rotatable idler roller 44 mounted on a central shaft 45 which is attached to base plate 22 to permit the top card in the stack to be driven from the stack and moved into a card transfer path.

Figure 7:
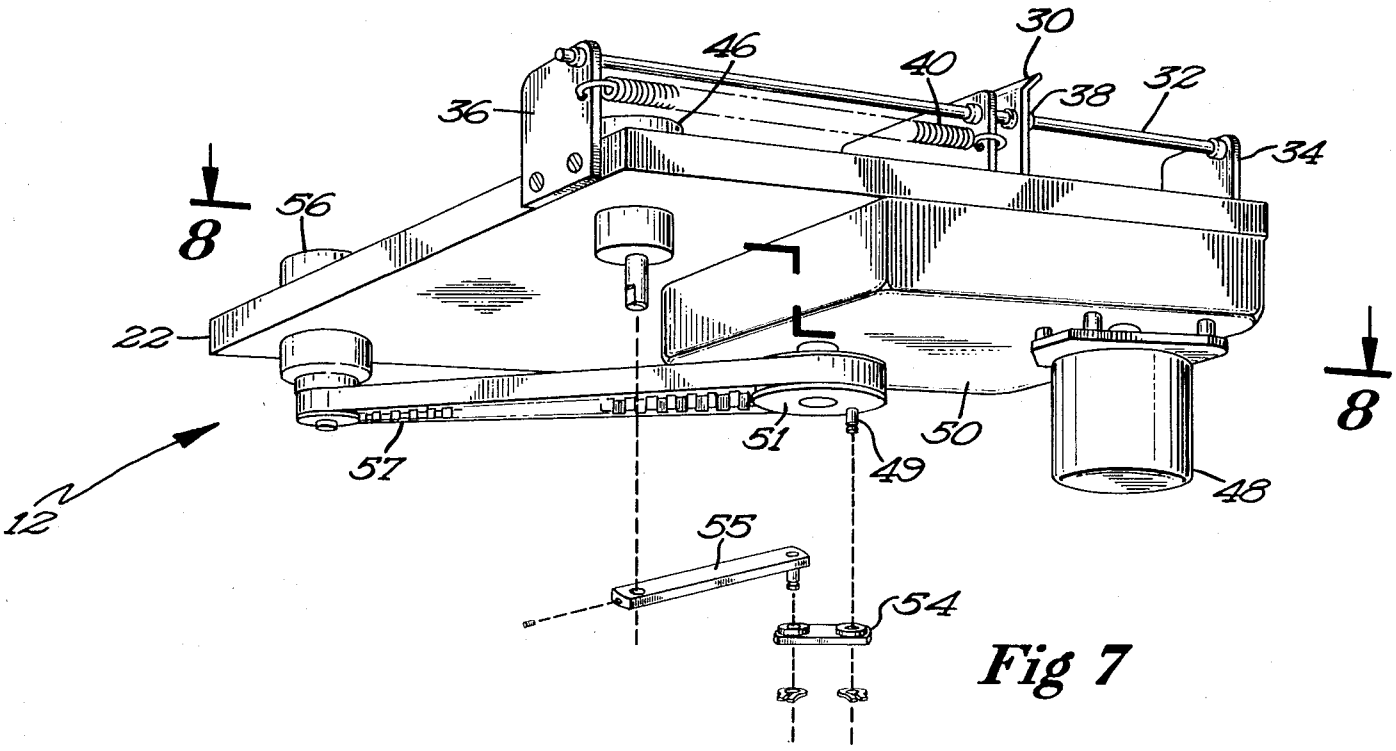
FIG. 7 is a partially exploded perspective view of the drive mechanism of the input feed magazine viewed from below.

As best shown in FIGS. 1 and 7, individual cards 28A are stripped from card stack 28 by a picker cam 46. Picker cam 46 has a projecting portion 53 which projects slightly from the surface thereof. It is driven by a motor 48 which drives a gear box 50 which, in turn, drives a linkage which provides an oscillatory drive for cam 46. The linkage consists of a coupler link 54 pivotally connected at one end to a crank arm 49 projecting from the disc of pulley 51 and at the other end to a first end of a rocker link 55. The other end of rocker link 55 is connected to the shaft 53 of picker cam 46.

For each complete revolution of pulley 51, picker cam 46 goes through a cyclic partial revolution. In order to strip a card from the top of card stack 28, motor 48 is driven through a complete cycle to rotate pulley 51 a full revolution. Cam picker 46 is oriented with its projection 53 aligned with the face of the top card in stack 28 so that the cyclic rotation of picker 46 forces projection 53 into abutting contact with the edge of the card and applies a force to the card tending to strip it from the stack and propelling it to the right and into the card transfer path of the machine. Card supports 42 keep the card vertically aligned and allow it to be moved across the face of the card stack.

Wheel 56 is driven counterclockwise as viewed from the top of the machine. The drive force for wheel 56 is provided by timing belt 57 which drives a pulley which is not shown but is attached to the other end of the shaft 58 upon which wheel 56 is mounted. Wheel 56 provides additional drive force to card 28A to remove it from stack 28 and slide it to the right between front 57 and rear 58 card supports which, with connecting pins 59, form two sides and the base of a card guide means for receiving the top card as it is stripped from card stack 28 and for supporting it in substantially vertical alignment with its top edge exposed, as shown in phantom outline in FIG. 1, for example. The precise longitudinal positioning of card 28A in card guide supports 58 and 59 is not critical because the transport mechanism is capable of compensating for variations in the positioning of cards fed from the card hopper as discussed below.

CARD TRANSPORT MECHANISM

After a card has been stripped from input hopper 12 and delivered to the card guide means at the beginning of the card transfer path, it is then engaged by a card carriage 60. Card carriage 60 is similar to the card carriage shown in U.S. Pat. No. 4,271,012, assigned to the assignee of the present invention, and the description of card carriage 180 in that patent is incorporated herein by reference.

Figure 6:
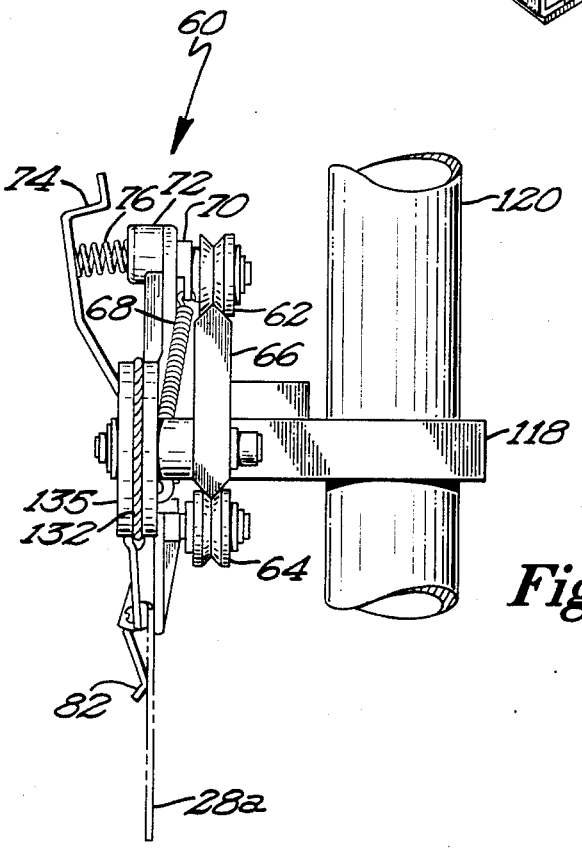
FIG. 6 is a cross-sectional view taken along lines 6—6 of FIG. 2 showing the details of the release mechanism for the card transport apparatus of the present invention.

As shown in FIGS. 1 and 6, card carriage 60 has an upper flanged wheel 62 and at least one lower flanged wheel 64 which ride on interfitting top and bottom surfaces, respectively, of a horizontal carriage rail 66. A spring 68 is connected between the frame of carriage 60 and a pivotally mounted arm 70 upon which wheel 62 is mounted. Spring 68 maintains a positive force between the upper wheel 62 and the lower wheel 64 of carriage 60 to cause it to firmly grasp rail 66.

Card carriage 60 has a support plate 72 which serves as the mounting surface or frame upon which wheels 62 and 64 are mounted. A pivotally movable plate 74 is mounted on plate 72 and is maintained in a normally "closed" position by compression spring 76. A card 28A is shown in FIG. 6 in the nip of a projection 78 attached to support frame 72 and a projection 80 attached to plate 74 while the carriage is in the "closed" position. Carriage 60 itself engages and supports the card in the same manner as the carraige 180 shown in U.S. Pat. No. 4,271,012.

In the preferred embodiment of the invention shown, carriage 60 also includes a pair of downwardly depending bias springs 82 which are attached to the depending fingers 80 of the movable plate 74 and apply a slight bias pressure to the surface of card 28A relative to the fixed downwardly depending projection 78 from support plate 72. Springs 82 can also be seen in position against the surface of a card in FIG. 1. The function of the springs 82 will be discussed in more detail in connection with the discussion of operation of the output hopper portion of the mechansim.

In the embossing system shown in U.S. Pat. No. 4,088,216, a complex transport mechanism for driving the cards in both the vertical and horizontal axes was shown. In that patent, the rail 188 was raised and lowered at both ends by separate cables and pulleys and complex control arm linkages are required to guide the cable used to move the carriage horizontally along the rail. The vertical and horizontal drive mechanisms of the preferred embodiment of the present invention offer a more efficient, simpler and inventive mechanism for controlling the vertical elevation and horizontal transport of a card engaged by carriage 60.

Figure 4:
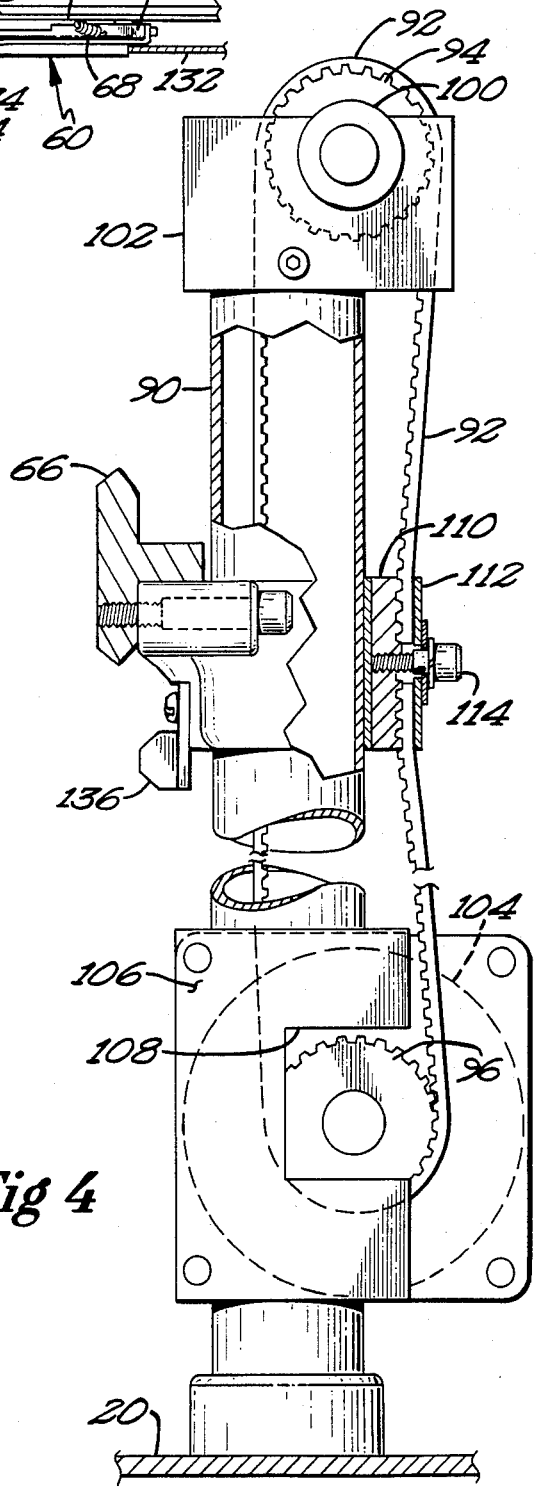
FIG. 4 is a cross-sectional view taken along lines 4—4 of FIG. 2 showing the vertical drive elements for the card transport apparatus of the embossing system.

FIG. 4 shows important elements of the vertical drive mechanism. The vertical drive support 90 is the primary support for rail 66 upon which carriage 60 travels. A timing belt 92 is enclosed within the confines of the vertical support 90, passing over timing pulleys 94 and 96 mounted at the top and bottom of the vertical support 90, respectively. The shaft of pulley 94 is supported by suitable bearings 100 mounted within a bearing block 102. At the base of vertical support 90, the stepper motor 104 is connected to timing pulley 96 and mounted on a mounting block 106, which supports the motor upon which pulley 96 rotates. Pulley 96 is positioned in an aperture 108 in the lower portion of the wall of vertical support 90 to permit timing belt 92 to exit above the base of the vertical support which is mounted on base plate 20. After timing belt 90 has been passed through vertical support 90, the free ends thereof are joined together by a rack segment 110 and a timing belt clamp portion 112 which are secured together by a bolt 114 to join both ends of the timing belt into a complete loop, while attaching the timing belt to vertical support carriage 116 upon which track 66 is mounted.

Rotation of motor 104 drives pulley 96 and timing belt 92 to apply appropriate forces to carriage 116 to raise and lower track 66 in coordination with rotation of stepping motor 104. The control of the operation of stepper motor 104 by appropriate control electronics is not specifically shown herein.

The other end of track 66 is mounted to a vertical slide rail bearing 118 which is mounted on a second vertical support 120 for slidable movement therealong. As stepper motor 104 is driven to raise and lower rail 66, support 120 keeps rail 66 in its proper angular orientation relative to vertical support shaft 90.

In order to engage a card which has been stripped from the input hopper and positioned in the guide between support plates 57 and 58, rail 66 is positioned to align carriage 60 with the top edge of the card. Carriage 60 is forced into its card engaging operating position by a fixed cam surface 122 which is a ball bearing assembly mounted on a shaft 124 carried by a release arm 126 which is, in turn, mounted on a mounting bracket 128 which is also directly attached to rail 66.

As carriage 60 is moved fully to the left, it forces pivotally movable plate portion 74 into the opened position with the jaws between projections 80 and 78 separated. The horizontal drive motor 130 is actuated to drive cable 132 to propel carriage 60 to the right. Cable 132 is driven by capstan or pulley 133 which is mounted on the shaft 134 of motor 130. At its other extremity, cable 132 passes over idler pulley 135. As carriage 60 moves to the right, bearing 122 is withdrawn from pivotally movable plate portion 74, allowing carriage 60 to grasp the card in the nip of the projecting jaws 78 and 80.

Motor 130 is controlled to drive carriage 60 to the right to the embossing portion of the machine where the embossed characters are to be applied.

As the card moves to the right, its trailing edge triggers a photosensor assembly 136 mounted on the rail support carriage 116. Photosensor assembly 136 reflects a ray of light from the surface of a card suspended from carriage 60 to a sensor located within the same housing. As card 28 is moved to the right, as viewed in FIG. 1, the sensor detects reflected light until the trailing edge of card 28A passes the sensor. The change in sensor output gives the control electronics a uniform signal indicating the card is at a predetermined reference position. Thus, the card transport can accurately control movement of the card from the reference position to and through the entire embossing operation, even if the card was initially mispositioned in guides 57 and 58. The card transport mechanism is therefore able to compensate for cards which are picked up by carriage 60 at different longitudinal positions.

The embossing equipment at the embossing station does not form a part of the present invention. The embossing portion of the system shown in U.S. Pat. No. 4,088,216, which is incorporated herein by reference, or any similar embossing mechanism can be utilized.

The embossing module of U.S. Pat. No. 4,088,216 is one where all of the embossing characters are applied at the same point, the "emboss location," relative to the card transfer path. In the preferred embodiment of the present invention, the information to be applied to the face of the credit cards is to be applied in one or more rows of embossed data by embossing wheels 140 driven by an embossing motor 142. The vertical position of rail 66 is adjusted by vertical drive motor 104 to allow each of the rows to be properly placed on the cards. The card is scanned across the emboss location of the embossing mechanism under the control of stepper motor 130. The control circuitry for applying power to the motors 104 and 130 does not form a part of the present invention and its construction is not specifically shown because it is apparent to one skilled in the art. The horizontal position of the card is measured by counting the pulses which have been applied to the stepper motor.

After all of the desired data has been embossed on the surface of a particular card, motor 130 drives the card to the extreme right hand position as shown in FIG. 1 to position the card above output hopper 14. After embossing is completed, the vertical drive moves track 66 to its highest vertical position. After carriage 60 reaches the extreme right position, rail 66 is lowered by motor 104 and the pivotally movable portion 74 of carriage 60 is forced open by the camming action of roller bearing 162 which is mounted on a shaft 163 mounted on arm 164 which is in turn mounted on vertical support 166. After the card is released, track 66 is raised and carriage 60 is rapidly traversed to the left to return to a full left position where its jaws are forced open to await another card from input magazine 12. If desired, a switch or other sensor may be used to give an output indicating that the extreme left-hand position has been reached.

It can be seen that the card transport mechanism according to the present invention is simple in operation and does not require the use of complex solenoid arrangements to engage and disengage the carriage from the card. Instead, the card transport mechanism of the present invention causes the operation of the card carriage by passive cam surfaces when the carriage passes over them. Because of the simplicity of the arrangement, there is no need to provide elaborate mechanisms for sensing the position of the card and operating carriage activating solenoids.

OUTPUT HOPPER

Figure 2:
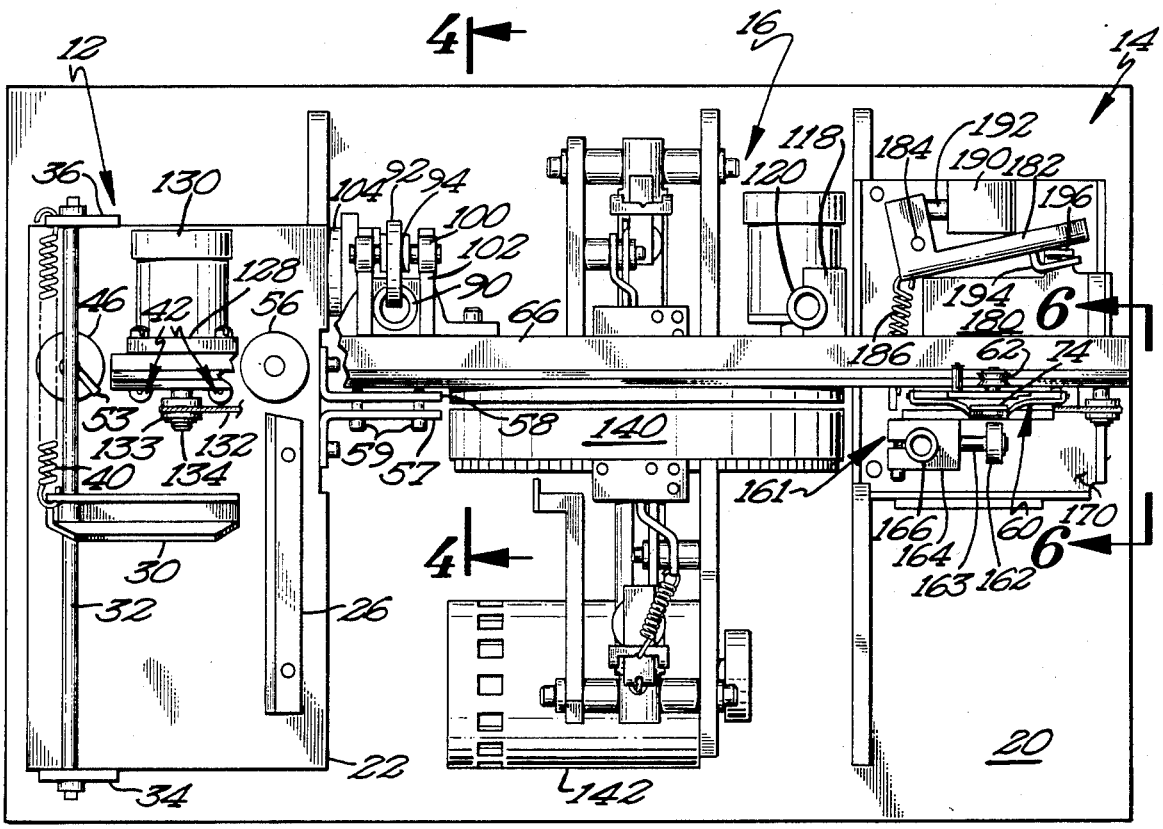
FIG. 2 is a top plan view of the embossing system.
Figure 8:
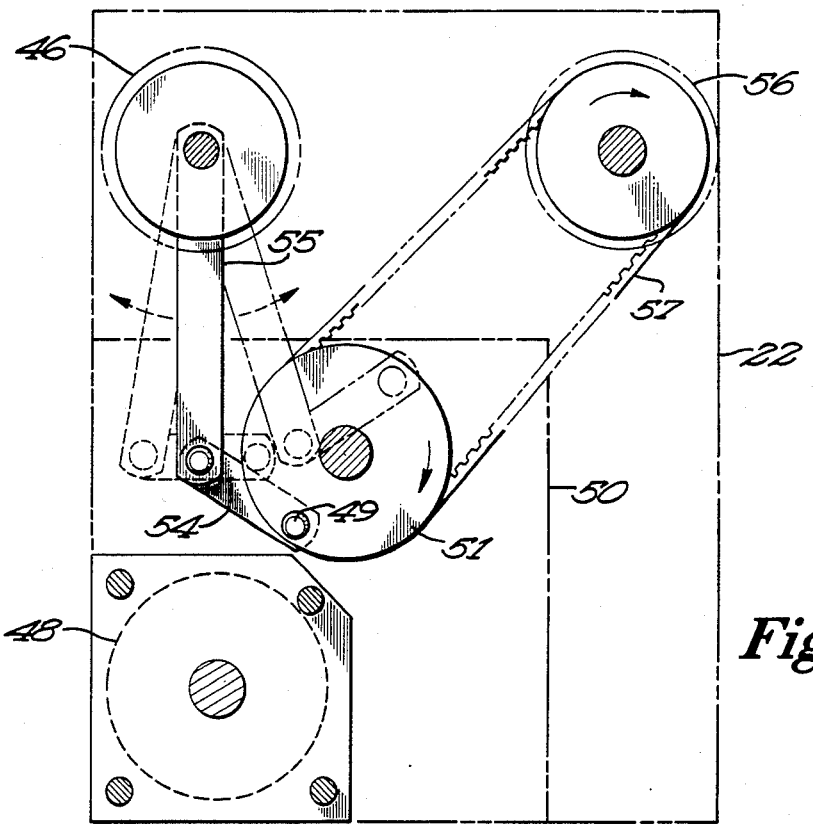
FIG. 8 is a sectional view along the lines 8—8 of FIG. 7 showing the movement of the four bar linkage which drives the card picker cam with additional positions of the links shown in dashed outline.
Figure 3:
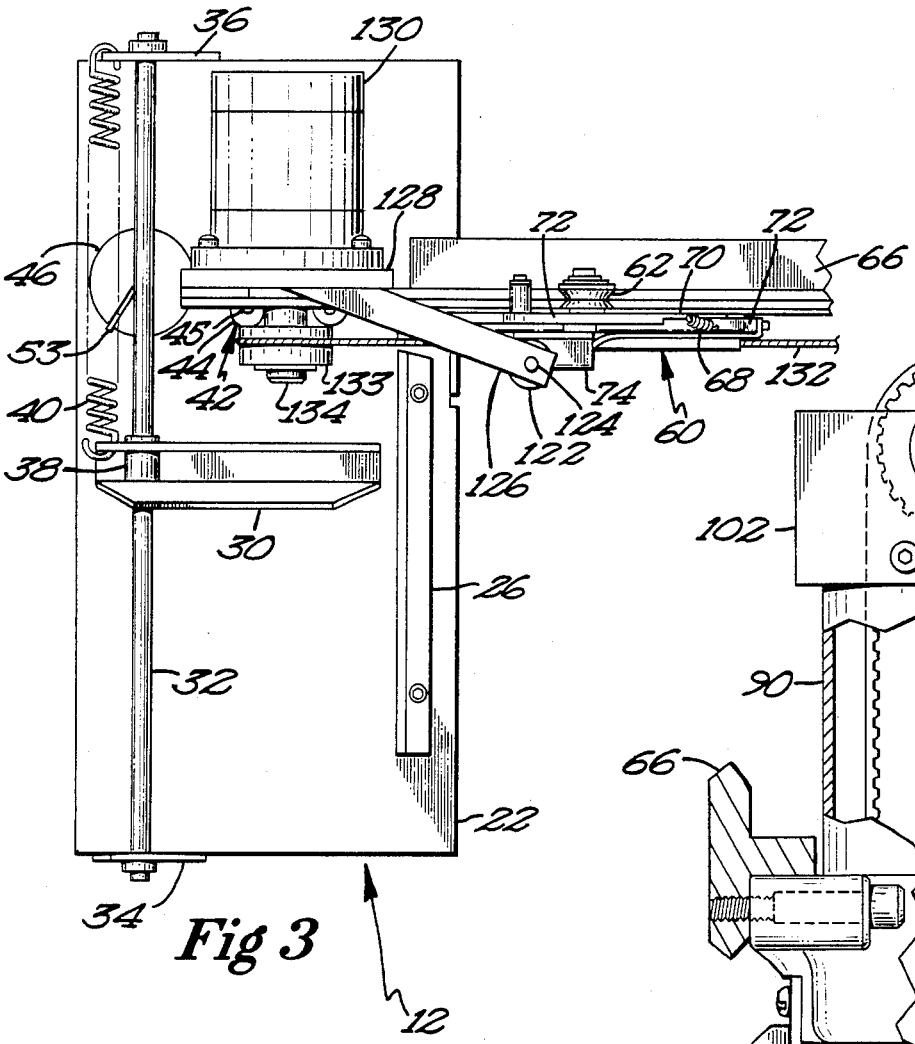
FIG. 3 is a top plan view of the input hopper portion of the card feeding mechanism of the embossing system.
Figure 5:
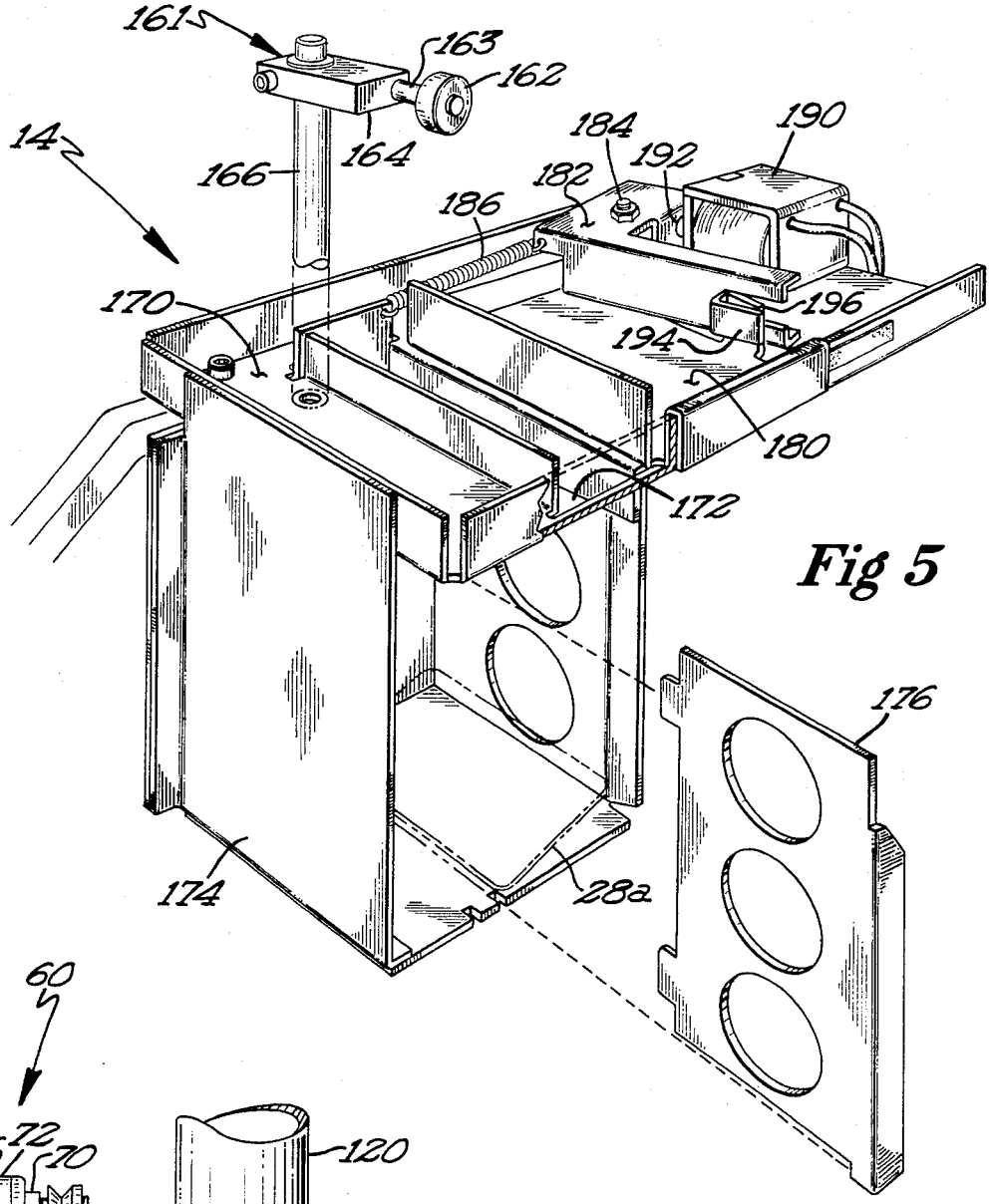
FIG. 5 is an exploded view of the output and reject hopper mechanisms of the present invention.

Output hopper portion 14 of the present invention is shown in partially exploded form in FIG. 5. In FIG. 2, the output hopper portion 14 of the system is shown at the right of the Figure. FIG. 6 shows a sectional view of carriage 60 positioned above the output mechanism.

As can be seen in FIG. 5, support 166 for the carriage release cam assembly 161 is mounted on the base plate 170 of output hopper assembly 14. Base plate 170 has an aperture 172 therethrough which allows cards released from carriage 60 to drop into the receving hopper which is suspended below aperture 172 of base plate 170. Output hopper guide 176 is placed in a location in receiving hopper 174 to cause the cards falling through aperture 172 to fall into a tilted position as shown rather than a flat position. It has been found that the tilted position allows the cards to fall more reliably than an entirely flat position.

In order to assure eligible operation for cards having varying weight and aerodynamic characteristics, it may be necessary to provide receiving hopper 174 with a spring-biased floor plate which is raised to receive initial cards after a short free fall drop. The spring bias would be slowly overcome by the weight of the received cards and the floor would slowly drop to allow more cards to be received.

Turning now to FIG. 6, the reason for the addition of bias springs 82 to carriage 60 will become apparent. If cards were released from carriage 60 and dropped from an initially vertical attitude, some of the cards would tend to land in the tilted position shown in FIG. 5 in phantom view while an equal number of cards would normally tend to fall in the opposite attitude with the left side elevated. In order to provide for a consistent orientation of the cards, bias springs 82 were added to carriage 60 to apply a clockwise rotational torque to the top edge of each card as it is released from carriage 60.

At the completion of the embossing operation, it is occasionally determined that the card embossing step contained an error or that the card for some reason was not properly embossed. In that event, it is necessary to make certain that the card is rejected and not mixed with good cards in the output hopper of the machine. This is accomplished in the present machine by providing a reject tray which may be interposed between the card transfer path and the output hopper bin.

As shown in FIG. 5, a reject bin 180 is shown positioned adjacent aperture 172 on hopper base plate 170. Bin 180 is linked to reject arm 182 which is mounted for limited pivotal movement to hopper base plate 170 by cap screw 184 and locking nut 186. Reject arm 182 is normally biased into the position shown in FIG. 5 by the operation of extension spring 186 which exerts a counterclockwise rotational torque about screw 184. When a reject card has been detected by the control electronics of the system, solenoid 190 is actuated and its shaft 192 is retracted to overcome the bias force of spring 186 and force the projecting portion 194 of reject arm 182 against the projecting flange 196 of reject bin 180. Bin 180 is moved over aperture 172 and intercepts the defective card as it is released from carriage 160. The operator can then remove the reject card from the reject bin at a time convenient to him.

What is claimed is:

1. Apparatus for receiving a stack of cards to be embossed and for individually feeding cards into a card transfer path of an embossing mechanism in an automatic embossing system, each of the cards in the stack of cards being vertically aligned and resting on an edge thereof, the stack of cards having a top, a bottom, first and second ends and first and second sides, said apparatus comprising:

(a) an input hopper for receiving a stack of cards to be embossed, said input hopper comprising:
  1. a hopper plate supporting the bottom of the card stack;
  2. a guide rail mounted on the hopper plate and engaging the first side of the card stack;
  3. a card picker cam mounted for limited rotational movement on the hopper plate and positioned adjacent the first end of the card stack, the picker cam constructed and arranged with a projecting lobe portion for engaging the edge of the card and sliding the card across the end of the stack into the transfer path;
  4. a backup plate slidably mounted on the hopper plate engaging the second end of the card stack and including means for urging the stack of cards into engagement with the card picker cam;

(b) card guide means mounted adjacent the hopper plate and aligned with the transfer path for receiving a card stripped from the card stack in the input hopper and supporting the card in vertical alignment with the top edge thereof exposed;

(c) carriage means constructed and arranged for engaging the top edge of a card;

(d) first positioning means for moving the carriage means horizontally along the card transfer path between the card guide means and the embossing apparatus; and (e) second positioning means for moving the carriage means vertically to engage a card in the card guide means.

2. The invention of claim 1 wherein the input hopper also includes a wheel which is driven to assist the picker cam to drive the top card in the card stack from the stack and into the card transfer path.

3. The invention of claim 2 wherein the input hopper also includes at least one vertical support means for maintaining the front of the card stack in a vertical orientation adjacent the card picker cam and the drive wheel.

4. The invention of claim 2 wherein the drive wheel and the card picker cam are driven from a common rotating drive mechanism.

5. The invention of claim 4 wherein the drive wheel is driven continuously by the rotating drive mechanism and the picker cam is driven by the rotating drive mechanism by means of a linkage.

6. The invention of claim 5 wherein the linkage comprises a first link pivotally connected at one end to a rotating disc driven by the rotating drive mechanism and the other end pivotally connected to the end of a crank arm connected to the picker cam.

7. Apparatus for receiving a stack of cards to be embossed and for individually feeding cards into a card transfer path of an embossing mechanism in an automatic embossing system, each of the cards in the stack of cards being vertically aligned and resting on an edge thereof, the stack of cards having a top, a bottom, first and second ends and first and second sides, said apparatus comprising:

(a) input hopper means for receiving a stack of cards to be embossed and for sliding the top card of the stack into the card transfer path;

(b) card guide means mounted adjacent the input hopper means and aligned with the transfer path for receiving a card stripped from the card stack in the input hopper means and supporting the card in vertical alignment with the top edge thereof exposed;

(c) carriage means constructed and arranged for engaging the top edge of a card, said carriage means including at least one pair of card engaging jaws normally biased into a closed position and hinged plate means for opening the jaws when actuated;

(d) first positioning means for moving the carriage means horizontally along the card transfer path between the card guide means and the embossing apparatus;

(e) second positioning means for moving the carriage means vertically to engage a card in the card guide means;

(f) first camming surface means for actuating the hinged plate means and opening the card engaging jaws when said first positioning means moves the carriage means adjacent the card guide means for receiving a card therefrom;

(g) second camming surface means mounted adjacent the card transfer path for actuating the hinged plate means and opening the card engaging jaws and releasing the card when said first and second positioning means move the carriage means to the end of the card transfer path; and (h) output hopper means mounted at the end of the card transfer path for receiving cards from the carrage means.

8. The invention of claim 7 wherein the first camming surface is constructed and arranged for actuating the hinged plate as the carriage means is moved horizontally toward the card guide means.

9. The invention of claim 7 wherein the second camming surface is constructed and arranged for actuating the hinged plate as the carriage means is moved vertically downward at the end of the card transfer path toward the output hopper means.

10. The invention of claim 7 wherein the carriage means includes bias means for causing cards released from the carriage means to fall with the same surface of the card aligned upwardly.

11. The invention of claim 7 wherein the horizontal positioning means comprises:

horizontally oriented track means aligned with the card transfer path upon which the carriage means is slidably mounted; and drive means mounted on the track means for sliding the carriage means along the track means.

12. The invention of claim 11 wherein the horizontally oriented track means is mounted on vertical positioning means which comprises:

a vertical support means mounted adjacent the card transfer path and upon which the track means is vertically movable;

drive means; and coupling means connected to the drive means for raising and lowering the track means under control of the drive means.

13. The invention of claim 12 wherein:

the vertical support means is a hollow shaft portion and has first and second pulleys mounted at the top thereof and is an aperture near the base thereof;

the coupling means is a timing belt, one segment of which passes over the first and second pulleys and through the vertical support means and the other segment of which is attached to the track means which is slidably mounted on the vertical support means; and the drive means has an output shaft connected to drive one of the first or second pulleys to raise and lower the track means.

* * * * *